US005255497A

United States Patent [19]

Zoromski et al.

[11] Patent Number: 5,255,497

[45] Date of Patent: Oct. 26, 1993

[54] FLAT SIDED FORMING TUBE FOR A FORM-FILL-SEAL MACHINE

[75] Inventors: Maynard J. Zoromski, Elmhurst; Kraig L. Klopfenstein, Barrington, both of Ill.

[73] Assignee: Triangle Package Machinery Co., Chicago, Ill.

[21] Appl. No.: 787,262

[22] Filed: Nov. 4, 1991

[51] Int. Cl.[5] ..... B65B 9/06

[52] U.S. Cl. ..... 53/551; 53/552

[58] Field of Search ..... 53/450, 451, 550, 551, 53/552, 554, 563; 493/295, 302; 24/701

[56] References Cited

U.S. PATENT DOCUMENTS

| | | | |
|---|---|---|---|
| 1,078,434 | 11/1913 | Haga | 24/701 |
| 1,455,383 | 5/1923 | Bates | 53/451 |
| 2,403,057 | 7/1946 | Davis | 24/701 X |
| 3,473,291 | 10/1969 | Raymond et al. | 493/302 X |
| 3,543,468 | 12/1970 | Leasure | 53/451 |
| 3,879,917 | 4/1975 | Bassendale et al. | 53/552 X |
| 4,008,651 | 2/1977 | Pain . | |
| 4,117,649 | 10/1978 | Egli . | |
| 4,442,656 | 4/1984 | Wylie, Sr. . | |
| 4,587,795 | 5/1986 | Yamashita | 53/551 |
| 4,640,083 | 2/1987 | Takahashi et al. . | |
| 4,932,105 | 6/1990 | Muller | 24/701 X |
| 4,991,379 | 2/1991 | Boeckmann . | |

FOREIGN PATENT DOCUMENTS

| | | | |
|---|---|---|---|
| 171477 | 11/1921 | United Kingdom | 24/701 |

*Primary Examiner*—John Sipos
*Assistant Examiner*—Daniel Moon
*Attorney, Agent, or Firm*—Willian Brinks Olds Hofer Gilson & Lione

[57] ABSTRACT

A form-fill-seal machine, for converting a continuous sheet of sealable film into bags, filling and then sealing the bags, in which the vertical forming tube is fabricated from a rectangular sheet of stainless steel material by making a plurality of equal angle and equal spaced bends in the stainless steel material and joining the ends together with a butt weld such that the vertical forming tube has a regular polygon cross section

30 Claims, 2 Drawing Sheets

Fig. 1
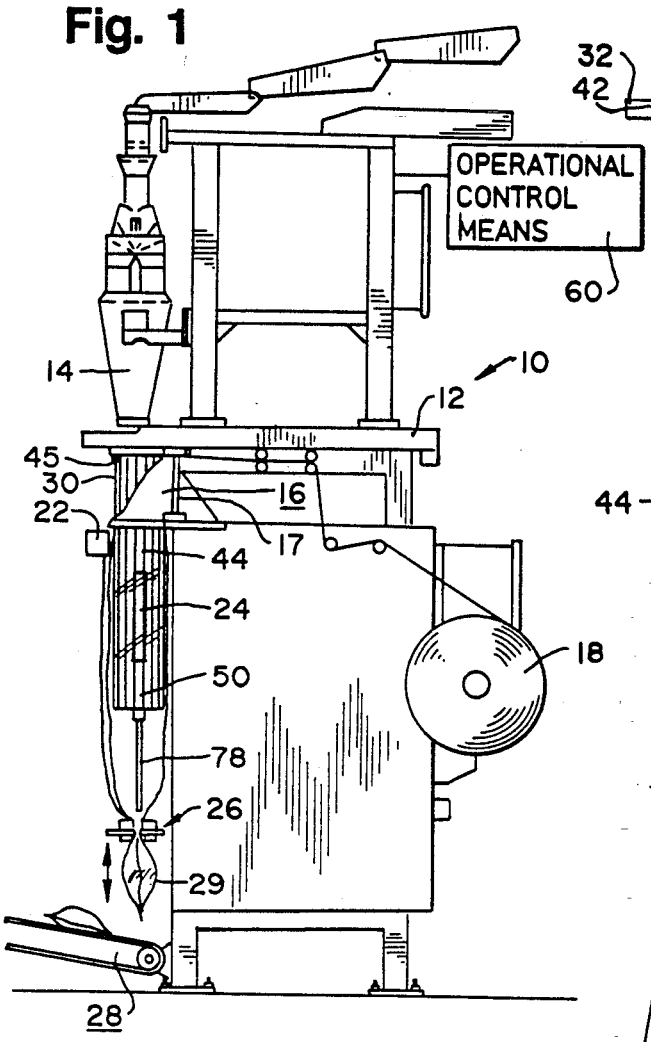
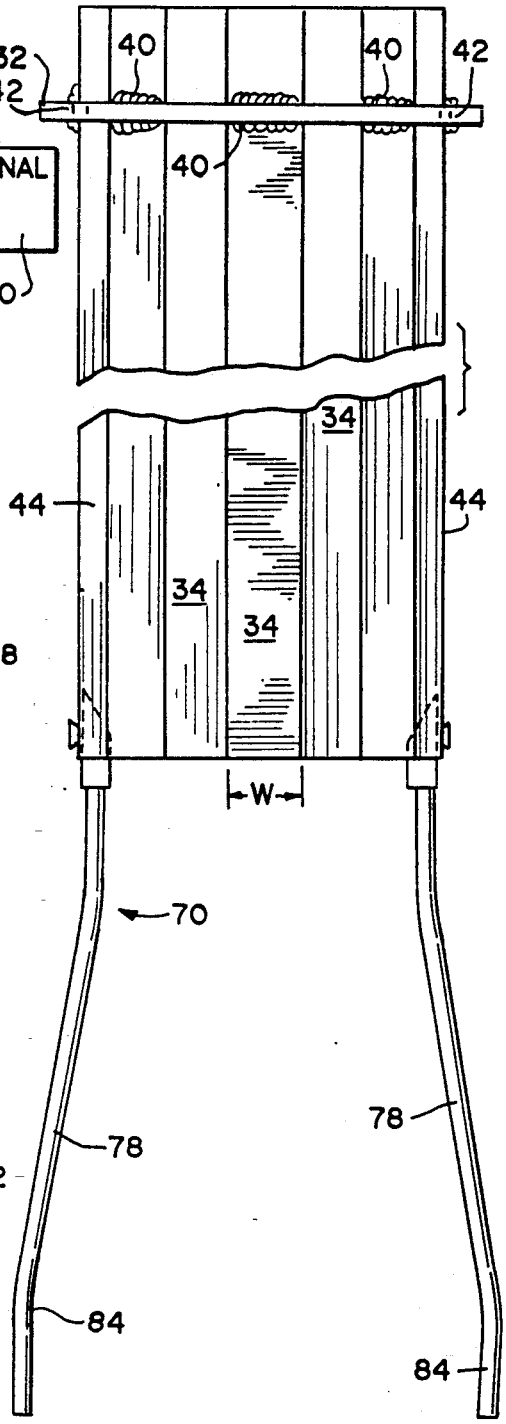
Fig. 3
Fig. 2
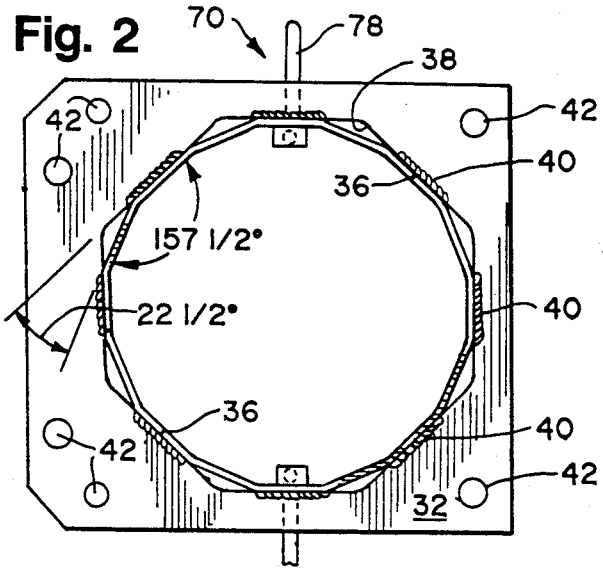

Fig. 4
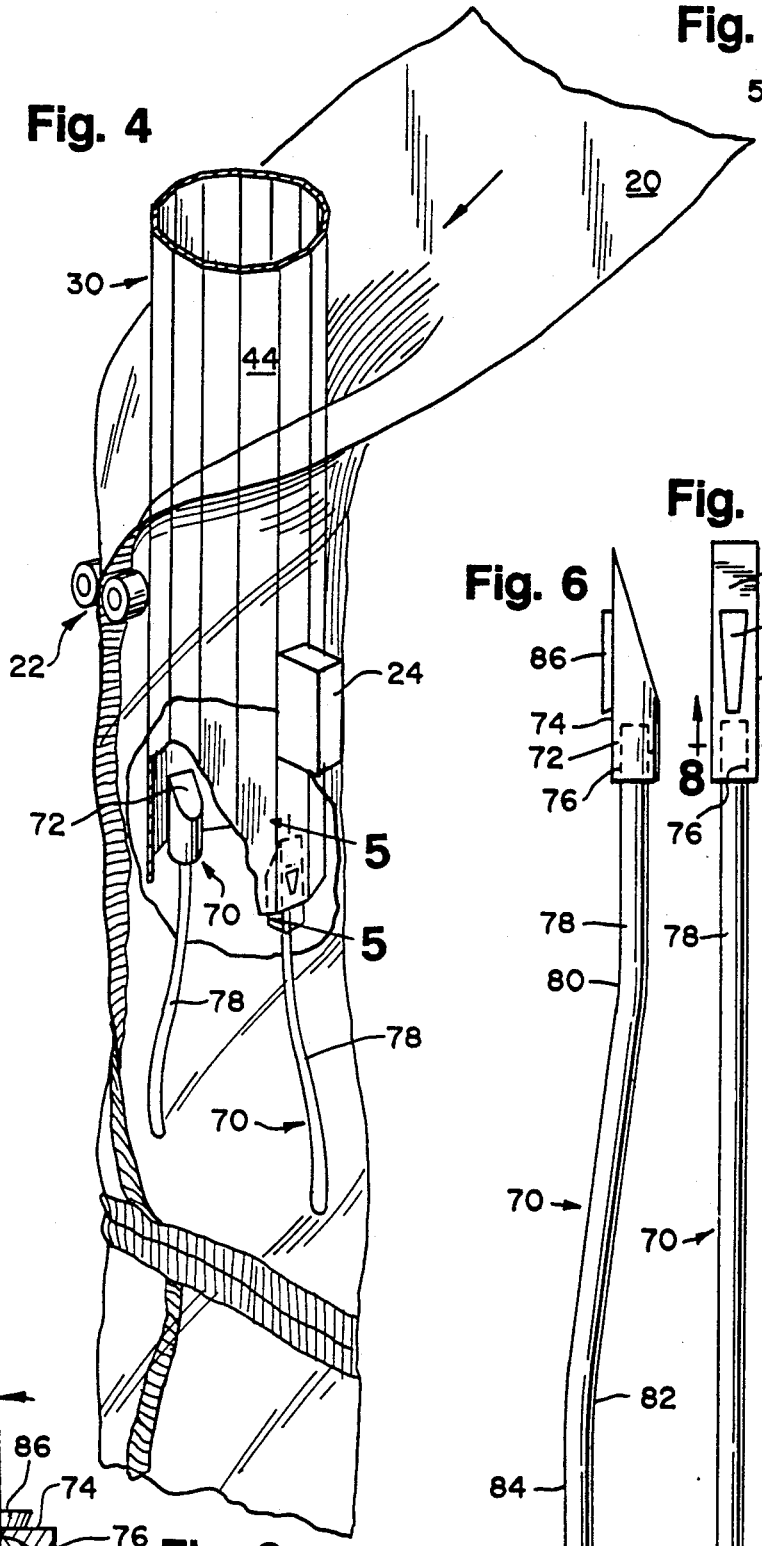
Fig. 5
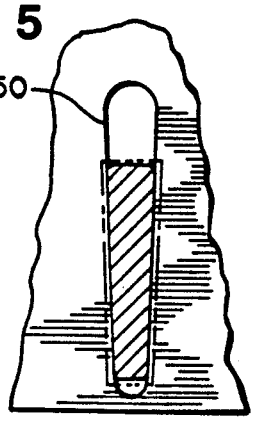
Fig. 6
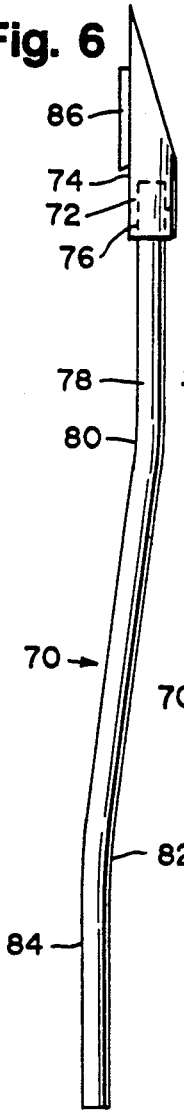
Fig. 7
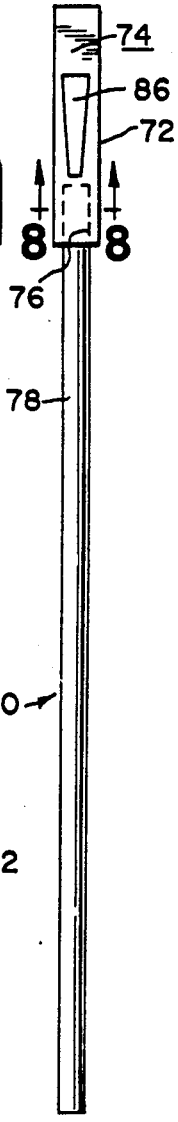
Fig. 9
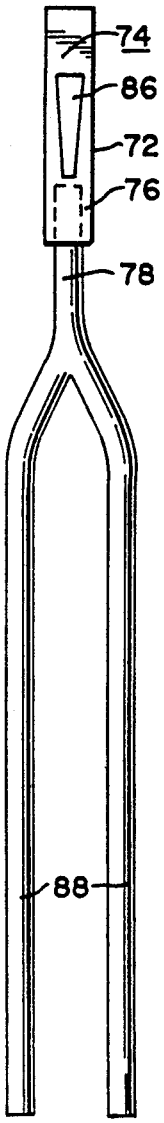
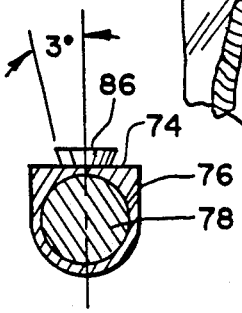
Fig. 8

FLAT SIDED FORMING TUBE FOR A FORM-FILL-SEAL MACHINE

BACKGROUND OF THE INVENTION

This invention relates to an apparatus for producing bags, and more particularly to a machine for making, filling and sealing bags made from a continuous sheet of sealable film.

More particularly, the invention relates to an improved forming tube around which the sealable film is wrapped to form a sleeve and through which the product is dropped to fill the bag.

There are numerous types and sizes of form-fill-seal machines commercially available. These machines typically pull a sealable film from a continuous roll over a forming shoulder that wraps the film into a generally tubular shape and overlaps the longitudinal edges. As the film leaves the forming shoulder it surrounds the outer surface of a vertical hollow forming tube. The usual forming tube is machined, to precise tolerances, from stock tubular material. The outer surface is turned to insure a smooth and uniform cylindrical surface, and parallel flat elongated areas are machined on opposite sides on the tube for cooperation with advancing belts to pull the film from the roll. In addition, securing surfaces are machined to facilitate attaching spreaders and other attachments to the forming tube and for accurately mounting the forming tube in its proper location on the machine.

Form-fill-seal machines include some type of dispensing means for filling the bag with product. In a typical machine a product dispensing hopper is located above the upper end of the forming tube and functions to dispense, at the appropriate time, a measured amount of product into the interior of the forming tube.

A vertical sealing device is located adjacent the forming tube and functions to form a seam along the overlapped longitudinal edges of the sealable film to form it into a sleeve. A pair of advancing belt devices are located on opposite sides of the forming tube that cooperate with longitudinal flat surfaces on the forming tube to pull the sealable film off its roll and over the forming shoulder.

An end sealing device is located below the lower end of the forming tube that functions to form both the bottom and top lateral seals for the bags.

A cutting means is provided to sever a filled and sealed bag from the next bag that is yet to be completed.

A form-fill-seal machine can be adapted to produce a variety of different size and or shaped bags, within its range. To adapt a machine for a different size or shaped bag it is usually necessary to replace the forming tube with a different one of appropriate size and shape. A form-fill-seal machine of the type described above is described and claimed in common owned U.S. Pat. No. 3,287,199 which is incorporated herein by reference.

The forming tubes used in current machines are fabricated from relatively thick walled cylinders in order to insure the necessary structural strength after machining the flats for the advancing belts. As a result, the finished forming tube is heavy and difficult to handle and the task of changing forming tubes is difficult and time consuming. Also, as a result of the extensive machining operations required in their fabrication, they are very expensive.

In forming an acceptable bag, it is important that the advancing belts be able to pull the sealable film down smoothly and evenly to avoid wrinkling, stretching or tearing of the film. The sleeve formed from the sealable film tends to cling to the smooth cylindrical surface of conventional forming tubes requiring a relatively large force from the advancing belts to index the sleeve down the forming tube.

The interior of the forming tube, being cylindrical, facilitates swirling of the product as it falls through the interior of the forming tube. The swirling product takes a greater amount of time to settle into the bag before it can be sealed and thus slows down the filling process.

Clamps that grasp the cylindrical surface of the forming tube are used to secure the forming tube in place on the machine. Proper alignment is not inherent in such a mounting and special care must be taken before clamping the forming tube in place to insure proper positing of the advancing belt flats and attachments such as the spreaders.

SUMMARY OF THE INVENTION

The present invention is directed to the fabrication of a forming tube from a flat sheet of stainless steel material, of uniform thickness, that is bent a plurality of times at equal angles such that the longitudinal edges of the sheet meet and can be joined together to thus form a tube having a regular polygon shaped cross section with an even number of longitudinal flat surfaces. The tube can be manufactured from a single piece of stainless steel material, however, the bending equipment must be accommodated internally of the tube. It has been found that manufacturing the tube can be facilitated by fabricating the tube from two or more separate pieces of stainless steel material. For example, a forming tube having sixteen longitudinal flat surfaces can be formed by making eight bends of approximately 22½ degrees each in two identically shaped flat sheet of stainless steel material. The internal angle of each such bend is approximately 157½ degrees. All bends in each sheet are made an equal distance apart; however, the first and last bends on each sheet are spaced, from the edge of the sheet, one half the distance between bends. When the two halves are joined the longitudinal edges will meet, between two bends, and can be butt welded together. Stainless steel sheet material, of uniform thickness, and having the optimum surface finish on both surfaces is commercially available and the expensive machining step to attain the proper surface finish is eliminated.

A pair of parallel longitudinal extending flat surfaces of the forming tube of the present invention can function in cooperation with the advancing belts and, thus, such surfaces do not have to be separately machined.

It has also been found that, as a result of the line contact, the drag between the sealable film and the forming tube of the present invention is less than that found when using a forming tube having a cylindrical surface. This reduces the required force that must be exerted by the advancing belts to index the sleeve formed from the sealable film down the forming tube.

The present invention has also resulted in an improved tracking of the sealable film as it moves off of the forming shoulder to surround the forming tube.

The non-cylindrical internal surface of the present invention forming tube has reduced the undesirable swirl characteristic that is present in the prior art devices having cylindrical internal surfaces.

Also, as the product is dropped into the bag being formed, air is displaced. This displaced or vented air can in the present invention escape upwardly through the channels formed by the flat surfaces of the forming tube and the sealable film, which tends to form arcuate bridges between the intersections of the flat surfaces.

The forming tube of the present invention has thinner walls, and is thus lighter, than existing forming tubes but has, as a result of its regular polygon cross section, a greater structural strength.

The forming tube of the present invention includes an integrally connected mounting plate including mounting apertures that insure proper alignment of the flat surfaces that cooperate with the advancing belts. This mounting plate, along with the overall lighter weight of the present invention forming tube, has reduced the time and effort required to change forming tubes when the machine is to be used to make a different size or shaped bag. The flat external and internal surfaces of the present invention vertical forming tube facilitate securing attachments to the forming tube and mounting the tube on the machine.

BRIEF DESCRIPTION OF THE DRAWINGS

FIG. 1 is a side view of a form-fill-seal bag forming machine having the forming tube of the present invention mounted thereon;

FIG. 2 is a top view of the forming tube of the present invention; FIG. 3 is a front view of the forming tube of the present invention;

FIG. 4 is a perspective view of the forming tube of the present invention, showing the film, sleeve and bag;

FIG. 5 is an enlarged side view of the spreader attachment slot;

FIG. 6 is a front view of one embodiment of a spreader attachment;

FIG. 7 is a side view of the spreader attachment of FIG. 6;

FIG. 8 is a view of the spreader attachment shown in FIGS. 5, 6 and 7 taken along lines 8—8 in FIG. 7; and FIG. 9 is a side view of a second embodiment of a spreader attachment.

DETAILED DESCRIPTION OF THE PREFERRED EMBODIMENT

Referring now to FIG. 1 of the drawing, a presently preferred embodiment of the invention is illustrated and includes, a form-fill-seal bag forming machine 10 having a vertical forming tube 30 that has been fabricated from a sheet of stainless steel material. The form-fill-seal bag forming machine 10 has a frame 12 which supports a product dispenser 14. The product dispenser 14 functions to dispense batches of product, that have been weighed by a computer weighing apparatus, at the proper time in the form-fill-seal machine's operating cycle. Computer weighing apparatus that perform such as this are shown in commonly owned U.S. Pat. Nos. 4,538,693 and 4,901,807 which are incorporated herein by reference.

The vertical forming tube 30 is mounted on the frame 12 immediately below the dispenser 14, such that product that is dispensed from the dispenser 14 is received internally of the vertical forming tube 30. As shall be discussed in detail below, the vertical forming tube 30 includes a mounting plate 32 that cooperates with corresponding mounting means on the frame 12 to facilitate convenient and properly aligned mounting.

A forming shoulder 16 is secured to the frame 12, by mounting means 17, adjacent but spaced from the upper end of the vertical forming tube 30. Forming shoulder 16 wraps around the upper end of forming tube 30 and is open at the front. A continuous roll 18 of sealable film 20 is mounted on the frame 12 such that a layer of sealable film 20 can be pulled off the roll 18 as the roll 18 rotates. The sealable film 20 is pulled over or through a series of rollers and over the forming shoulder 16 which shapes the sealable film 20 into a generally tubular shape with overlapping edges that extend through the front opening of the forming shoulder 16. As the sealable film leaves the forming shoulder 16, it is moving in a downwardly direction where it encounters the vertical forming tube 30. A vertical sealing device 22 is supported adjacent the front of the vertical forming tube 30 below the front opening of the forming shoulder 16. The vertical sealing device 22 functions to form a seam along the overlapped edges to thus form the sealable film into a sleeve. A pair of advancing belts 24 (only one is shown) are located on opposite sides on the vertical forming tube 30 for engagement with the sealable film sleeve and cooperation with parallel longitudinal flat surfaces of the vertical forming tube 30. The advancing belts 24 are controlled by the operational control means 60 of the form-fill-seal machine 10 such that at the appropriate time in the machine cycle they are actuated. Upon being actuated, the sides of the advancing belts, that are pressing the sleeve against the longitudinal flat surfaces of the forming tube 30, move downwardly. The sleeve is indexed downwardly one bag length and the upstream sealable film is pulled over the forming shoulder 16 and unrolled from the roll 18.

An end sealing and cutting device 26 is located below the lower end of the vertical forming tube 30. Device 26 is controlled by the operational control means 60 of the machine 10, and functions to form a lateral top seal in the bag that has been filled and a lateral bottom seal in the next bag to be filled. Device 26 also functions to sever the filled and sealed bag from the sleeve of sealable film. The filled and sealed bag falls to a conveyor 28 which carries the completed bag to a packaging station.

In FIG. 1, the end sealing and cutting device 26 is shown in its closed position supporting a filled bag 29. After the cutting mechanism of device 26 has severed the completed bag 29 from the sleeve and the device 26 cycles to its open position, the completed bag 29 drops to the conveyor 28.

Referring now to FIGS. 2 and 3, there is shown top and front views, respectively, of the preferred embodiment of the vertical forming tube 30. FIG. 2 is orientated such that the edge of the mounting plate 32 having four mounting apertures 42 is the back edge. The back edge of the plate is the edge that would be closest to the roll 18, as seen in FIG. 1.

In the preferred embodiment, the longitudinal extending portion of the vertical forming tube 30 is fabricated from two rectangular shaped sheets of stainless steel material. One dimension of the rectangular sheet of material is the desired overall length of the vertical forming tube 30. The other dimension is equal to one half of the width W of longitudinal flat surfaces 34 times the number of longitudinal flat surfaces. The longitudinal extending portion of the vertical forming tube is fabricated such that its cross section is a regular polygon with an even number of sides. In the preferred embodiment illustrated in FIG. 2, there are sixteen longitudinal flat surfaces 34. Eight parallel bends of approximately 22½ degrees are made in each of the rectangular sheets of stainless steel material, spaced W distance apart. The first and last bends in each sheet are located a distance equal to ½W from the longitudinal edges of the sheet such that, when the two halves of the longitudinal extending portion of the vertical forming tube are joined, the longitudinal edges meet between the bends to be butt welded together as indicated at 36 in FIG. 2. A stainless steel mounting plate 32, having a regular octagon opening 38 cut therein, is welded along the periphery of opening 38 as indicated at 40 to certain of the longitudinal flat surfaces 34. Forming opening 38 in the shape of a regular polygon having half of the number of sides as there are longitudinal flat surfaces 34 facilitates inserting the sixteen sided tube into the eight sided opening 38, allows sufficient relative movement between the components such that they can be precisely aligned prior to applying the welds 40 around the periphery of the opening 38, and still provides ample engaging areas to firmly fix the two components together. A plurality of mounting apertures 42 are formed in mounting plate 32 which facilitates mounting vertical forming tube 30 on the machine 10 at a predetermined fixed position without the need for alignment or adjustments.

In FIGS. 1 and 4 the longitudinal flat surface specifically identified as 44 is one of the longitudinal flat surfaces that cooperates with the advancing belts 24 to index the sleeve formed from the sealable film.

As can be best seen in FIG. 1, the vertical forming tube 30 is secured to the machine 10 by fastening means 45 that extend through mounting apertures 42, into cooperating fastening means carried by the machine frame 12, resulting in precise means for locating the vertical forming tube 30 relative to the product dispenser 14, forming shoulder 16, vertical sealing device 22 and advancing belts 24.

An inverted tear dropped shaped spreader attachment aperture 50 is formed in each of the flat surfaces 44. Aperture 50 can be seen in FIG. 1 and in a larger scale in FIG. 5.

A first embodiment of a spreader attachment 70 is illustrated in FIGS. 1–7. Spreader attachment 70 includes a base member 72 having a flat surface 74, and a cylindrical shaped opening 76 into which is secured a spreader finger 78. As can be best seen in FIG. 6, spreader finger 78 has two bends 80 and 82. The bends 80 and 82 are of a magnitude and orientation such that a sleeve engaging edge 84 is displaced, as seen in FIG. 6, outwardly of the flat surface 74 of base member 72.

Base member 72 also includes a mounting wedge 86 that protrudes from its flat surface 74. As is indicated in FIG. 8 the sides of mounting wedge 86 are not square with flat surface 74, rather they are at an angle of degree to the flat surface. The angle of the sides of mounting wedge 86 to a line that is perpendicular to flat surface 74 is indicated to be 3 degrees in FIG. 8. It should be noted that the angle shown in FIG. 8 is exaggerated for illustrative purposes. As a result, the mounting wedge 86 has a smaller footprint at its base where it is connected to flat surface 74 than at its surface spaced away from flat surface 74. The length of mounting wedge 86 as seen in FIG. 7 is less than the length of spreader attachment aperture 50 and its height is greater than the thickness of the stainless steel sheet material used to fabricate the longitudinal portion of the tube 30. The spreader attachment 70 is attached to the vertical forming tube 30, without the use of special tools, by inserting the base member 72 into the open bottom of forming tube 30 such that mounting wedge 86 protrudes through the upper portion of the tear drop shaped opening 50 formed in one of the flat surfaces 44. As the spreader attachment is pulled in the downward direction, the mounting wedge 86 moves from the relatively large upper end of inverted tear drop opening 50 toward the relatively small lower end of inverted tear drop opening 50. The inclined walls of mounting wedge 86 function to cam the flat surface 74 of mounting member 72 flush against the backs of flat surface 44. The spreader attachment 70 can likewise be removed, without the use of tools, by forcing the attachment upwardly.

Referring now to FIG. 4, a perspective view of the vertical forming tube 30 of the subject invention is shown isolated from the machine 10. In this view the forming shoulder 16 is not shown; however, the sealable film 20 is shown as a flat sheet before it is wrapped around the vertical forming tube 30 and as a sleeve after it has been wrapped around the vertical forming tube 30. The forming shoulder 16 functions to wrap the flat sealable film around the vertical forming tube 30 and to overlap the edges. A vertical sealing device 22 seals the overlapped edges together to thus form the flat sealable film 20 into a continuous sleeve. Advancing belts 24, that are actuated at the proper time in the cycle by the Operating Control Means, press the sleeve against flat surfaces 44 and index the sleeve down one bag length each cycle. Only one of the advancing belts 24 has been schematically shown in FIG. 4, it being understood that there is another one on the opposite side of vertical forming tube 30. A portion of the vertical forming tube 30 has been broken away so that the base member 72 of spreader attachment 70 can be seen in its place on the inner flat surface 44 of the vertical forming tube 30. The spreader fingers 78 cause the sleeve to flatten out after it leaves the bottom end of vertical forming tube 30. The end sealing and cutting device are not illustrated in this figure however the resulting end seal is shown. The end seal is shown before being severed by the cutting device. The cutting device cuts through the end seal dividing it into an upper seal for the completed bag and a bottom seal for the next bag.

A second embodiment of spreader attachment 70 is shown in FIG. 9. In this embodiment, the spreader finger 78 has two tines 88. This embodiment of spreader attachment is used in the manufacturer of bags having a gusset, which are also known as expanding bags. The same base member 72 is used with this embodiment as used with the first embodiment. In the manufacture of gusset bags, a folding finger (not shown), supported on the machine frame 12 adjacent the free end of the spreader attachment 70, folds the tube inwardly between the tines 88. The end sealing mechanism then seals the tucked in portion of the tube along with the end seals to thus produce gussets at the top and bottom of the bag.

What is claimed is:

1. In an apparatus for forming, filling and sealing a series of bags, said apparatus including a vertical forming tube, having an upper and a lower end portion, about which a film can be wrapped to form a sleeve, an advancing mechanism for pulling the film along the length of said vertical forming tube from its upper end portion to its lower end portion, product for filling each bag being dispensed through the interior of said vertical forming tube, a vertical sealing means located adjacent said vertical forming tube for forming a longitudinal seam along the sleeve, end sealing means located adjacent the lower end portion of said vertical forming tube for closing the tops of filled bags and the bottoms of bags to be filled, wherein the improvement comprises:

the vertical forming tube is fabricated from stainless steel sheet material, having a uniform thickness, with a plurality of equally spaced parallel bends formed by bending said sheet material and joined together such that said vertical forming tube has a regular polygon cross section and includes at least three pairs of parallel longitudinal extending flat surfaces one pair of which is formed to cooperate with said advancing mechanism.

2. The invention as set forth in claim 1, wherein said vertical forming tube is fabricated from a plurality of rectangular shaped sheets that are joined together along their free edges.

3. The invention as set forth in claim 1, wherein said vertical forming tube is comprised of sixteen longitudinal flat surfaces.

4. The invention as set forth in claim 1, wherein said vertical forming tube is comprised of an even number of longitudinal extending surfaces.

5. The invention as set forth in claim 1, wherein said vertical forming tube includes flat mounting surfaces to facilitate mounting attachments to said vertical forming tube.

6. The invention as set forth in clam 5, wherein said flat mounting surfaces to facilitate mounting attachments are internally of said vertical forming tube.

7. The invention as set forth in claim 1, wherein a mounting plate is secured to said upper end portion of said vertical forming tube, said mounting plate having apertures formed therein through which fastening means may be extended to mount said vertical forming tube on said apparatus in precise alignment with cooperating elements of said apparatus.

8. The invention as set forth in claim 7, wherein said vertical forming tube is comprised of sixteen longitudinal flat surfaces.

9. The invention as set forth in claim 7, wherein said vertical forming tube is comprised of an even number of longitudinal extending surfaces.

10. The invention as set forth in claim 7, wherein said mounting plate has a regular polygon shaped opening formed therein through which said vertical forming tube extends and about the periphery of which said vertical forming tube is connected by welding to said mounting plate.

11. The invention as set forth in claim 10, wherein said vertical forming tube has an even number of longitudinal flat surfaces and said regular polygon shaped opening formed in said mounting plate has one side for every two longitudinal flat surfaces of said vertical forming tube.

12. The invention as set forth in claim 10, wherein said vertical forming tube is comprised of sixteen longitudinal flat surfaces.

13. The invention as set forth in claim 10, wherein said vertical forming tube is comprised of an even number of longitudinal extending surfaces.

14. A machine for converting a sheet of sealable film into a sealable film sleeve comprising:

a machine frame;

a roll containing a continuous sheet of sealable film mounted on said frame;

a forming shoulder, mounted on said frame, for shaping the sealable film into a generally tubular shape with overlapped edges;

a vertical forming tube, said vertical forming tube being mounted on said frame relative to said forming shoulder such that said generally tubular shaped sealable film surrounds said vertical forming tube as it moves off said forming shoulder and said vertical forming tube being fabricated from a generally rectangular shaped sheet of stainless steel material that has a plurality of parallel and equal bends formed by bending said sheet material, resulting in a tube with a regular polygon cross section and a minimum of three pairs of parallel longitudinal extending flat surfaces;

vertical sealing means, mounted on said frame, for forming a seam along the said overlapped edges; and advancing means for pulling said sealable film down said vertical forming tube, over said forming shoulder and unwinding it from said roll.

15. The invention as set forth in claim 14, in which said vertical forming tube comprises sixteen longitudinal flat surfaces.

16. The invention as set forth in claim 14, in which said vertical forming tube comprises an even number of longitudinal extending surfaces.

17. The invention as set forth in claim 14, wherein said vertical forming tube includes a mounting plate having a regular polygon shaped opening formed therein that receives and is secured, about its periphery, to said vertical forming tube.

18. The invention as set forth in claim 17, wherein said vertical forming tube has an even number of longitudinal flat surfaces and said regular polygon shaped opening formed in said mounting plate has one side for every two longitudinal flat surfaces of said vertical forming tube.

19. The invention as set forth in claim 14, wherein said vertical forming tube includes flat mounting surfaces to facilitate mounting attachments thereto.

20. The invention as set forth in claim 19, wherein said vertical forming tube includes attachment mounting apertures formed therein and said flat mounting surfaces are located internally of said vertical forming tube.

21. The invention as set forth in claim 20, including a mounting attachment, said mounting attachment including:

a base member having an attachment flat surface, a mounting wedge protruding outwardly from said attachment flat surface a distance greater than the thickness of said sheet of stainless steel material, said mounting wedge including inclined walls that are adapted to cooperate with said attachment mounting apertures to cam said attachment flat surface flush against one of said flat mounting surfaces of said vertical forming tube.

22. A tube spreading attachment for a form-fill-seal machine, of the type that has a stainless steel sheet metal vertical forming tube with a flat internal mounting surface and an attachment mounting aperture and a spreading finger attached to said base member converging side walls formed in the stainless steel sheet metal, the invention comprising:

said attachment including a base member having an attachment flat surface formed through the mounting surface and having longitudinally, a mounting wedge, adapted to extend into said mounting aperture, said mounting wedge having longitudinally converging side walls that protrude outwardly from said attachment flat surface and are aligned with said longitudinally converging side walls formed in the stainless steel sheet metal when said mounting wedge is located in said mounting aperture, said mounting wedge including a base connected to said attachment flat surface and a free end, said longitudinally converging side walls of said mounting wedge being inclined relative to a line that is perpendicular to said attachment flat surface, such that said mounting wedge has a larger footprint at its free end than at its base.

23. The invention as set forth in claim 22, said spreading finger having a sleeve engaging edge that is spaced outwardly of said attachment flat surface.

24. The invention as set forth in claim 23, wherein said attachment is a gusset bag spreader attachment and wherein said spreading finger includes a pair of parallel extending tines.

25. A machine for forming a sheet of sealable film into a bag, filling and then sealing the bag comprising:

a machine frame;

a roll, containing a continuous sheet of sealable film, mounted on said frame;

a forming shoulder, mounted on said frame, for shaping the sealable film into a generally tubular shape with overlapped edges;

a vertical forming tube including an upper end portion, said vertical forming tube being mounted on said frame relative to said forming shoulder such that said generally tubular shaped sealable film surrounds said upper end portion of the vertical forming tube as it moves off said forming shoulder, said vertical forming tube being fabricated from a generally rectangular shaped sheet of material that has a plurality of parallel bends formed therein, resulting in a vertical forming tube with a polygon cross section and a minimum of five longitudinal extending flat surfaces;

vertical sealing means formed to produce a seam along the overlapped edges of said sealable film;

advancing means formed to cooperate with at least one of said longitudinal extending flat surfaces for pulling said sealable film down said vertical forming tube and over said forming shoulder.

26. The invention as set forth in claim 25, wherein said generally rectangular shaped sheet is formed of stainless steel material having a plurality of parallel bends resulting in said polygon cross section.

27. The invention as set forth in claim 25, wherein said vertical forming tube is fabricated from a plurality of rectangular shaped sheets that are joined together along their free vertical edges.

28. The invention as set forth in claim 25, wherein said vertical forming tube includes flat mounting surfaces to facilitate mounting attachments to said vertical forming tube.

29. The invention as set forth in claim 25, wherein a mounting plate is secured to said upper end portion of said vertical forming tube, said mounting plate having apertures formed therein through which fastening means extend for mounting said vertical forming tube on said frame in precise alignment with cooperating elements of said machine.

30. The invention as set forth in claim 29, wherein said mounting plate has a polygon shaped opening formed therein through which said vertical forming tube extends and is connected by welding.

* * * * *